United States Patent [19]

Meier

[11] Patent Number: 4,676,519

[45] Date of Patent: Jun. 30, 1987

[54] WHEELCHAIR

[75] Inventor: Günter Meier, Porta Westfalica, Fed. Rep. of Germany

[73] Assignee: Günter GmbH Meier, Porta Westfalica, Fed. Rep. of Germany

[21] Appl. No.: 830,329

[22] Filed: Feb. 18, 1986

[30] Foreign Application Priority Data

Apr. 23, 1985 [DE] Fed. Rep. of Germany ..... 3514572

[51] Int. Cl.[4] ..... A61G 5/02

[52] U.S. Cl. ..... 280/242 WC; 280/649; 280/657; 297/DIG. 4

[58] Field of Search ..... 280/242 WC, 289 WC, 280/650, 657, 649, 647; 297/DIG. 4

[56] References Cited

U.S. PATENT DOCUMENTS

| | | | |
|---|---|---|---|
| 3,584,890 | 6/1971 | Presty | 280/289 WC |
| 4,042,250 | 8/1977 | Rodaway | 280/650 |
| 4,358,125 | 11/1982 | Charles | 280/242 WC |
| 4,428,594 | 1/1984 | Minnebraker | 280/242 WC |
| 4,500,102 | 2/1985 | Haury | 280/242 WC |
| 4,542,918 | 9/1985 | Singleton | 280/242 WC |

FOREIGN PATENT DOCUMENTS

| | | | |
|---|---|---|---|
| 8101365 | 5/1981 | European Pat. Off. | 280/242 WC |
| 8300321 | 8/1984 | Netherlands | 280/289 WC |

*Primary Examiner*—John J. Love
*Assistant Examiner*—Everett G. Diederiks, Jr.
*Attorney, Agent, or Firm*—Erwin S. Teltscher

[57] ABSTRACT

A wheelchair has two foldable side frames, link members which cross one another and are pivotable about a common horizontal axis so as to fold the side frames, front wheels and rear wheels connected with the side frames, a back rest with upwardly extending back supporting members, a seat with seat supporting members which are movable upwardly and downwardly in dependence upon a folding movement, and a foot support with foot support carrying arms, wherein each side frame is provided with guide receivers for the seat supporting members, and with supports for the link members, and wherein a rear wheel axle block and the front support carrying arms are formed as a one-piece element of synthetic plastic material. Such side frames have a lower weight, but are stable nevertheless, and also result in an improved handling of the wheelchair.

25 Claims, 10 Drawing Figures

WHEELCHAIR

BACKGROUND OF THE INVENTION

The present invention relates to a wheelchair. Many wheelchairs are known in the art. A known wheelchair, for example, has two side frames which are foldable by means of two crossing links, pivotable about a common horizontal axis, has steerable front wheels, and rear wheels larger than the front wheels, which are preferably manually drivable, and rotatably arranged on the side frames, a back rest which is held by a back rest support member, a seat which is carried by a seat support member, and is lowerable and raisable in dependence on the folding movement, and a foot support supported by carrying arms.

Such wheelchairs which are known in different embodiments, are composed in a large measure of metallic elements, and consequently are heavy and therefore not satisfactory in the sense of providing either travelling comfort during transportation, or adequate handling capability.

SUMMARY OF THE INVENTION

Accordingly, it is an object of the present invention to provide a wheelchair of the above-mentioned general type, which avoids the disadvantages of the prior art.

More particularly, it is an object of the present invention to provide a wheelchair of the above-mentioned general type, in which its main parts, and particularly its side frames, are composed of material having a lower weight, but which is nevertheless stable.

In keeping with these objects and with others which will become apparent hereinafter, another feature of the present invention resides, briefly stated,in a wheelchair, in which side frames are formed as one-piece elements of synthetic plastic material provided with guiding and support means for receiving additional individual parts of the wheelchair; such parts are added onto the side-frames during their manufacture, for example, by molding.

It is also an object of the present invention to provide a wheelchair of the above-mentioned general type, which is designed with simply mountable, easily manufacturable, as well as easily removable side parts with or without any arm supports, and wherein the wheelchair has a relatively low weight, but is stable nevertheless.

In keeping with these further objects, a plate-shaped side part of synthetic plastic material is removably arranged on each side frame. Bracket-shaped receiving pieces of synthetic plastic material are mounted on respective mounting tubes of the side frame and have a vertical insertion slot into which the above-mentioned side parts are releasably engaged with rods formed on their lower edges. The insertion slots of the receiving pieces side part extends upwardly as an outer extension of the frame. Each side part is formed at its rear edge in its upper region with an arresting bracket, by means of which it is releasably held on the back rest supporting member. At least one side part is provided with a vertically adjustable are support, which displaceably engages with its downwardly extending holding strip into a guiding groove formed in the side part. The arm support is arrestable in a stepped manner by an arresting pin which is held on the side part and engages in one opening of a row of openings in the holding strip.

When the wheelchair is designed in accordance with the present invention it has the following advantages.

The wheelchair is composed mainly of synthetic plastic material, so that it has a considerably lower weight than conventional wheelchairs, and thereby considerably improves handling, travelling comfort and facilitates transportation.

Each side frame is formed as a one-piece element of synthetic plastic material and during its manufacture is already provided with guiding and support means as well as mounting means for the seat supporting members, the rear wheel axle block, the foot support, the front wheels, and the side parts.

The side frames with the supporting members are mostely of tubular shape, which ensures a high degree of stability.

The seat supporting members which are movable upwardly and downwardly, depending on the folding movement, engage with their vertical metallic guiding members into the tubular guiding means of the side frames, so that additional stabilization of the side frames is provided.

The side parts are formed of easily manufacturable and stable synthetic plastic parts, which can be secured to, and released very quickly and reliably, together with their molded plugging and arresting means, from receiving pieces of synthetic plastic material provided on the side frames, and on the back rest supporting members.

The side parts have vertically adjustable arm supports which with their holding strips engage in molded grooves of the side parts, and are each arrestable in a selected vertical position by arresting means.

Moreover, the synthetic plastic parts of the wheelchair are formed with different colors, so that they no longer have the cold and impersonal metallic appearance of conventional wheelchairs, but instead they are provided with a colorful design which appeals more to a handicapped user and which no longer has the characteristics of a rolling or wheel chair, and thereby minimizes any antipathy of the handicapped user.

The novel features of the invention are set forth in particular in the appended claims. The invention itself, however, will be best understood from the following description of preferred embodiments, which is accompanied by the following drawings.

DESCRIPTION OF THE PREFERRED EMBODIMENT

Figure 1:
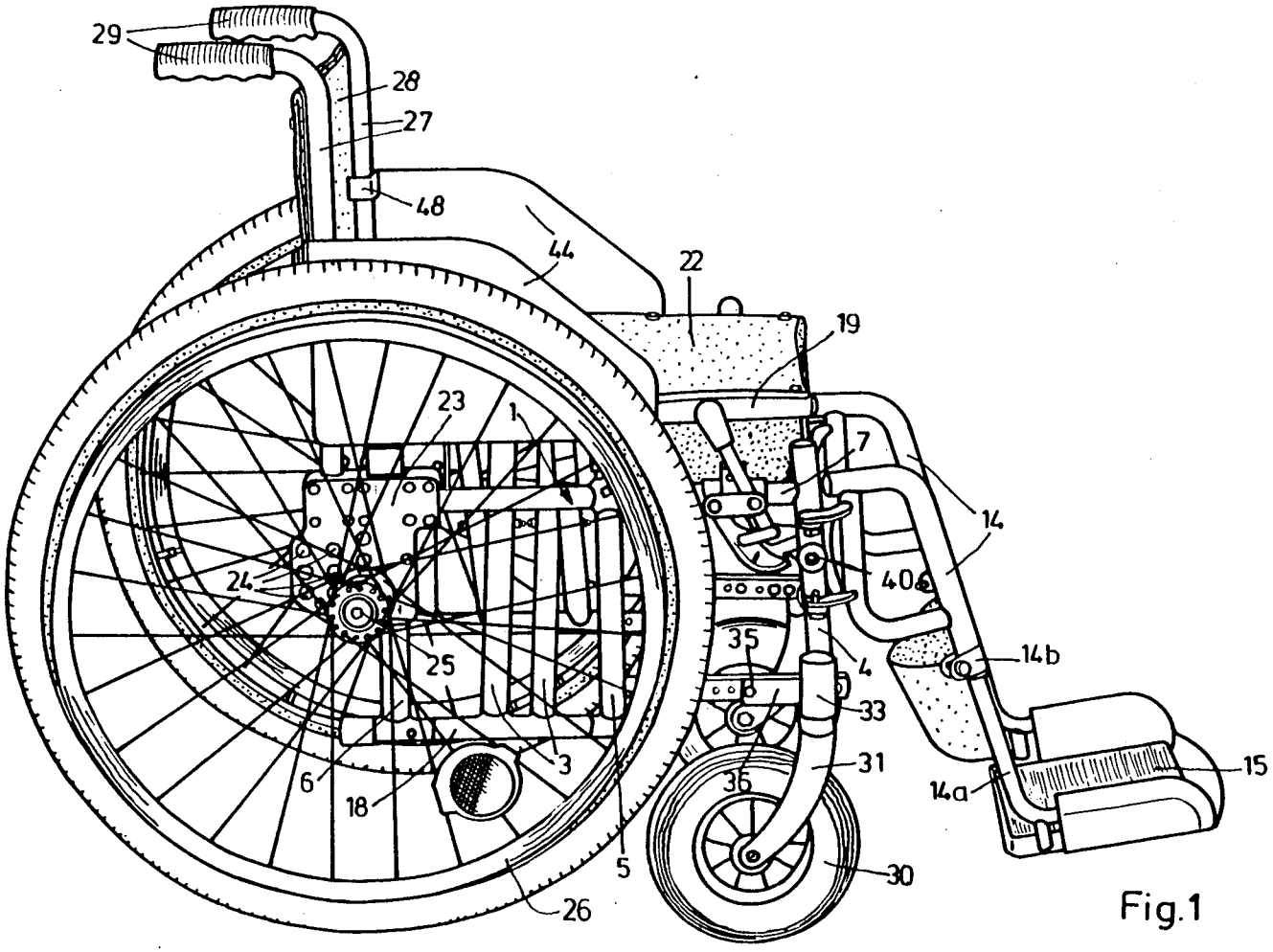
FIG. 1 is a perspective side view of a foldable wheelchair.

A foldable wheelchair, or rolling chair, has two side frames which are identified with the reference numeral 1. They are identical; however, some of their parts are mirror-symmetrical. The side frames 1 are arranged on both respective side regions of the wheelchair.

The side frames 1 are connected by two link members 3, which cross each other, and are pivotably connected with each other about a common horizontal axle 2, which extends along a travel direction of the wheelchair. Advantageously, four link members 3 are provided and are arranged in two pairs. The side frames 1, in their position of use, are held at a distance from one another. For folding they are moved toward one another, so that the distance between the side frames is reduced, and in the position of non-use they are located close to one another.

Each side frame 1 has a rectangular contour in a side view thereof, and is formed as a one-piece element of synthetic plastic material.

Each side frame 1 has a front upright supporting member 4, an upright guiding member 5 arranged rearwardly of and at a distance from the supporting member 4, and a further upright guiding member 6 arranged rearwardly of, and at a distance from the guiding member 5, as considered in a travelling direction of the wheelchair. The three members 4, 5, and 6 are held advantageously at the same distances from each other by two horizontal spacers 7, which extend between the members 4 and 5, as well as between the members 5 and 6. The spacers 7 are arranged in an upper region of the members 4, 5 and 6. End portions of these members, which extend upwardly beyond the spacers 7, form mounting pieces 4*a*, 5*a*, and 6*a*. Both guiding members 5 and 6 have the same length or height. The central guiding member 5 is provided at its lower end with a horizontal bearing sleeve 8, which extends in a traveling direction and projects at both sides of the guiding member 5. The rear guiding member 6 is provided at its lower end with a support member 9, which extends in a traveling direction and also projects on opposite respective sides of the guiding member 6. The support member 9 is coaxial with the bearing sleeve 8.

A spacer 10 extends, between the supporting member 4 and the guiding member 5, horizontally in the traveling direction. It is located above the bearing sleeve 8 at a distance from the latter and is connected to the lower end of the supporting member 4, which is shorter than the guiding member 5.

A mounting member piece 11 extends horizontally in the traveling direction from the rear guiding member 6, and forms an extension of the spacer 7. It is shorter than the support member 9, which extends parallel to the mounting piece 11 and under the mounting piece 11.

The upright supporting and guiding members 4, 5 and 6 and therefore the mounting pieces 4*a*, 5*a* and 6*a* which are formed on them, the horizontal support member 9, and the horizontal bearing sleeve 8 are formed of tubes. The horizontal spacers 7 and the mounting piece 11 are also formed of tubes. The horizontal spacer 10 is formed of a solid or hollow bar with the cross-section of a circle, a cornered shape such as a polygon, or a cornered shape (polygon) with rounded corners. The tubes 4, 5, 6, 7, 8, 9, and 11 have a circular cross section. Two support plates 12, provided with receiving openings, are formed, for example by molding on the outer side of the upright supporting member 4 and arranged at a distance one above the other. A carrying arm 14 of a front foot support 15 is releasably mounted on the support plates 12. A bracket-shaped reinforcement 16 is formed, for example by molding, between the supporting member 4 and the end of the spacer 10, and between the spacer 10 and the guiding member 5 as well as the bearing sleeve 8.

All the above mentioned parts 4–12 and 16 are produced of synthetic plastic material so as to form a one-piece side frame 1. Furthermore, bracket-like reinforcements 17 are formed, for example by molding between the supporting plates 12 and the supporting member 4 for supporting the plates, so that the entire side frame forms a single unit.

Each pair of the link members 3 is provided at the lower longitudinal end with a horizontal support tube 18, which extends coaxially between the bearing sleeve 8 and the support member 9. The support tube 18 turnably engages a non-illustrated pivoting axle in the bearing sleeve 8, and in the support member 9.

The upper end of the pair of link members 3 is mounted on a horizontal seat supporting member 19 extending in the travelling direction. The supporting member 19 rotatably engages two bearing sleeves 20, each having a downwardly extending guiding member 21. One guiding member 21 extends into the central guiding member 5 and the other guiding member 21 extends into the rear guiding member 6. The guiding members 21 which support the seat supporting member 19 are height-adjustable in the guiding members 5 and 6 of the side frame 1. During folding of the side frame 1 by means of the link members 3, the guiding members 21 move in the guiding members 5 and 6 upwardly or downwardly. During movement to the position of use they move inwardly of the guiding members 5 and 6, while during movement to the folded position they move outwardly of the guiding members 5 and 6, as can be seen from FIG. 5.

Both seat supporting members 19 carry a flexible seat 22 formed as a plane, a fabric or the like, of leather, synthetic leather, textile, synthetic plastic material or the like which can automatically fold and unfold.

An axle block 23 has a plurality of axle openings 24 arranged at a distance from each other for receiving a rear wheel axle 25 and is arranged in the rear upper corner region of each side frame 1 around its guiding member 6, spacer 7 and mounting piece 11. The axle block 23 is formed of two parts and overlaps both sides of the side frame parts 6, 7, and 11 in their joining region. It is mounted by screws or other means on the above-mentioned parts 6, 7 and 11. A rear wheel 26 larger than the front wheel 30, and which is advantageously manually driven is supported with its axle 25 in one axial opening 24. By selection of corresponding axial openings 24, rear wheels 26 of different respective sizes can be mounted in the axle block 23.

An upright back supporting member 27 is received in each axle block 23 with its lower end. At the upper end each back supporting member 27 has a handle 29 which is bent in a direction opposite to the travelling direction. A back rest 28, which is flexibly formed similar to the seat 22, is mounted on the supporting members 27.

Both front wheels 30 are steerable, and are of a smaller size than the non-steerable rear wheels 26. Each front wheel 30 is rotatably supported in a fork 31 which engages with an upright steering axle 32 in a bearing sleeve 33. The fork 31 is mounted, by means of screws 34, with a bearing sleeve 33 on the corresponding side frame 1 at a joining region between the supporting member 4 and the spacer 10. The fork 31 is also attached, by means of a rod 36, which is mounted on the bearing sleeve 33, to the spacer 10 by means of a screw 35. One or several openings 37 are provided in the spacer 10 for securing the rod 36 thereto, so that the front wheels 30 with different respective rods 36 can be secured in a stable manner to the side frame 1, and wherein the corresponding bearing sleeve 33 is secured to the rod 36.

Figure 3:
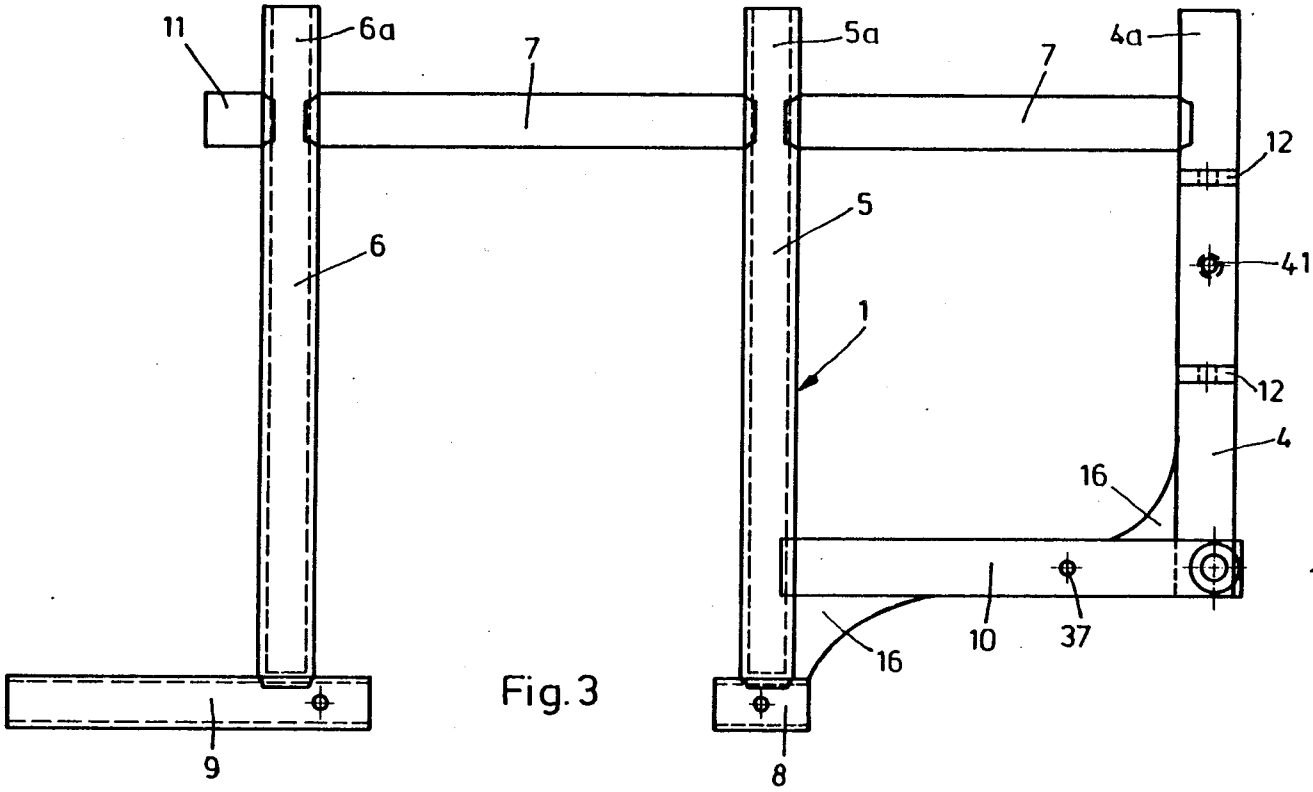
FIG. 3 is a side view of a one-piece side frame of the wheelchair.

A vertical bearing pin 13 is fixed in each bearing plate 12 of each side frame 1. The carrying arm 14 of the foot support 15, preferably a foot plate, is suspended with its brackets 38 on the bearing pins 13. The forwardly pointing position of the supporting arm 14 in the travelling direction is achieved by an abutment plate 39, which extends between the brackets 38 on the carrying arm 14, and also by an arresting pin 40. The abutment plate 39 lies on the supporting member 4, and the arresting pin 40 is held in an opening 41 of the supporting member 4 and engages an opening 42 of the abutment plates 39, as can be seen from FIGS. 1, 3 & 5.

Figure 2:
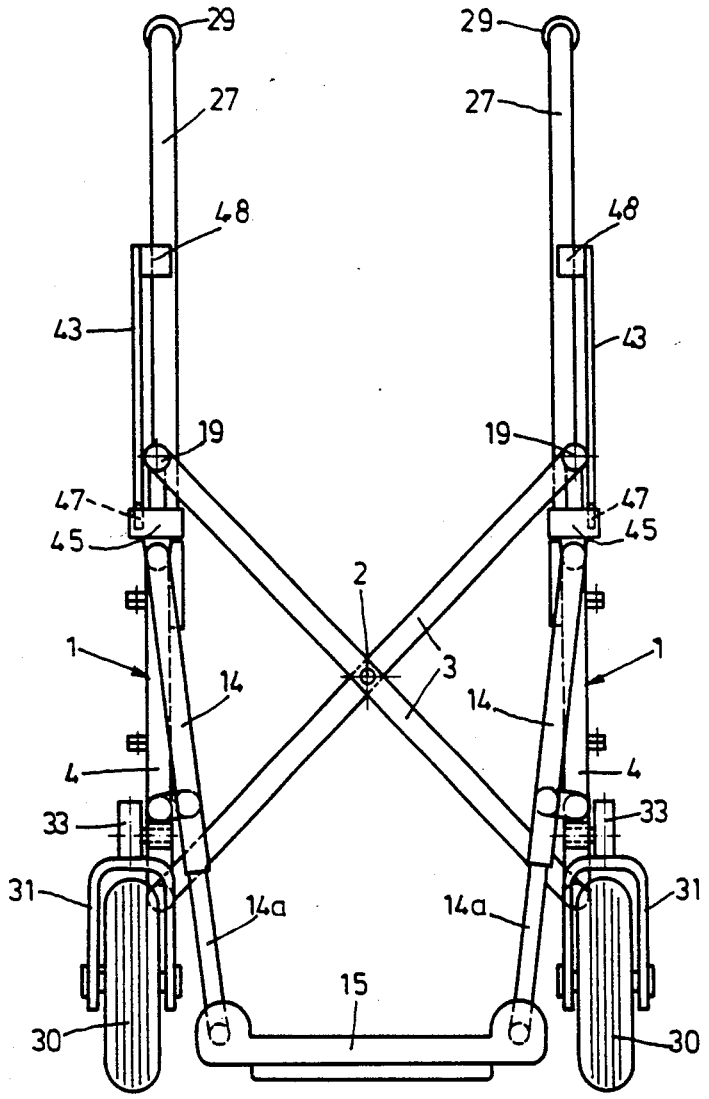
FIG. 2 is an end view of the same wheelchair, however, without any rear wheels, seat or backrest.
Figure 4:
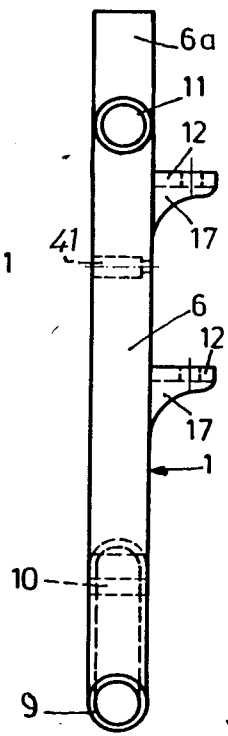
FIG. 4 is a rear view of the side frame of FIG. 3.
Figure 6:
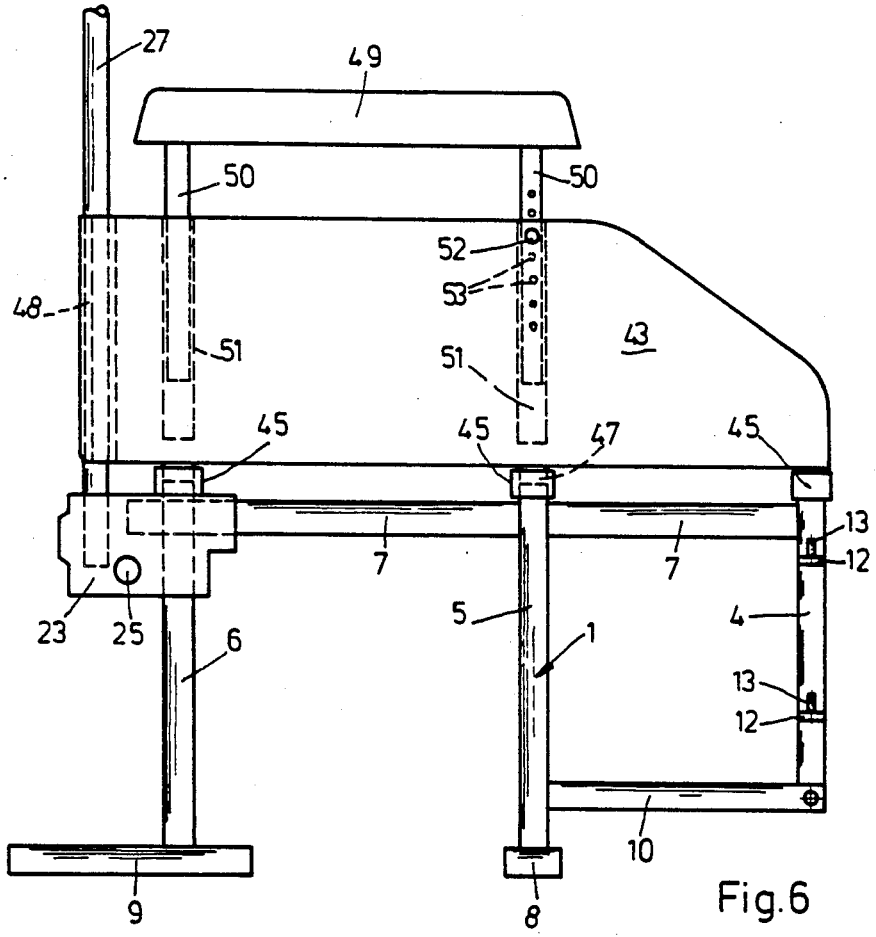
FIG. 6 is a side view of a side frame with one side part removed and an arm support which is vertically adjustable thereon.
Figure 7:
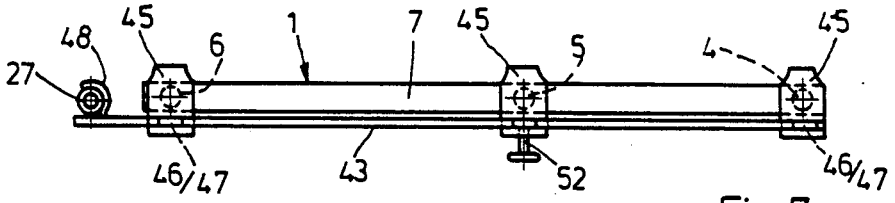
FIG. 7 is a plan view of a side part which is held on the side frame without any arm support.
Figure 8:
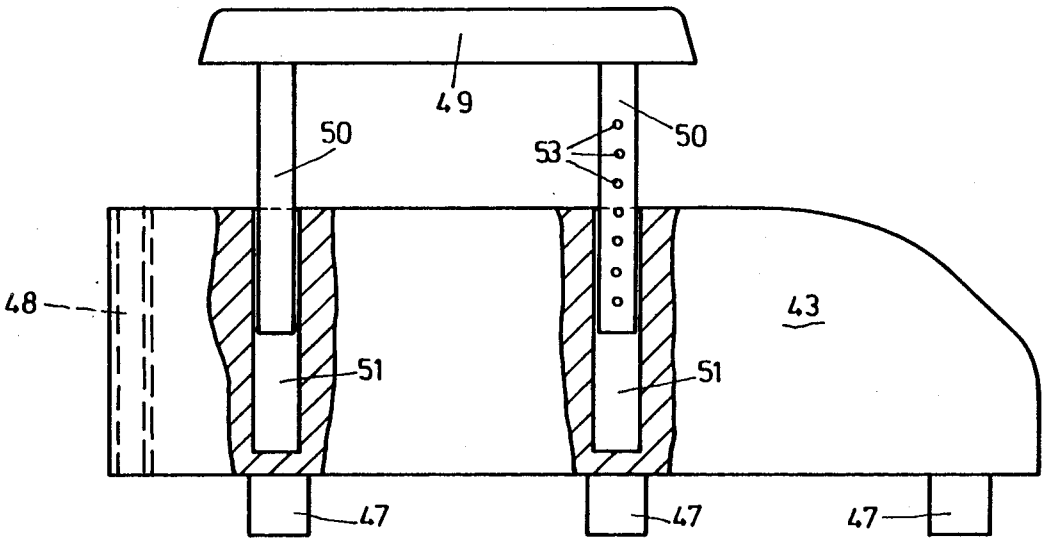
FIG. 8 is a side view, partially in section, of a side part with an arm support.
Figure 9:
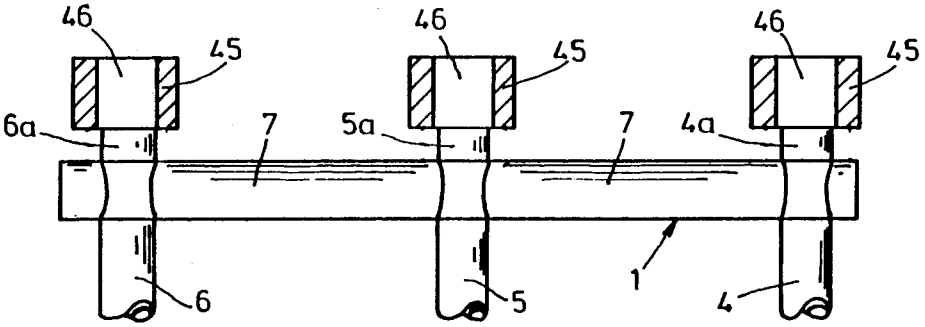
FIG. 9 is a side view of the upper end region of the side frame with receiving means for a plug connection of the side part.

A side part 43, 44 of variable size can be selectively and releasably mounted on each side frame 1, as shown in FIGS. 1, 2 and 6. For mounting of the side parts 43, 44, receiving pieces 45 of synthetic plastic material are mounted on the mounting pieces 4*a*, 5*a* and 6*a* in a bracket-like manner. Each receiving piece 45 has a vertical insertion slot 46, in which the side part 43, 44 can be inserted by means of a lower insertion rod 47, so that it is arranged in a standing position, and extends upwardly as an extension of the side frame 1. The insertion slots 46 lie outwardly of the outer side of the side frames, so that the seat supporting members 19 with their upright guiding members 21 can be moved upwardly and downwardly on the side parts 43, 44 in a non-interfering manner. Furthermore, the side parts 43, 44 are each fixed in their position on the respective supporting members 27 for the back rest by respective rear arresting brackets 48 provided in the upper end region of the wheelchair. The arresting bracket 48 extends at the inner side of each side part 43, 44, and partially surrounds the corresponding supporting member 27 for the back rest 28.

Figure 10:
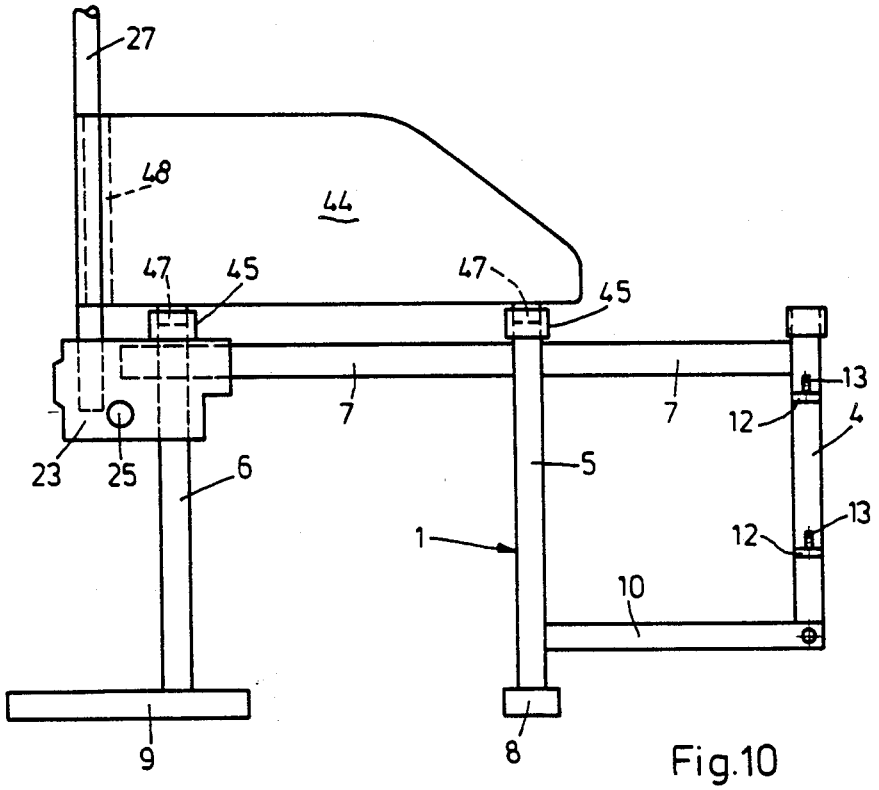
FIG. 10 is a side view of the side frame with the side part in accordance with another embodiment of the invention.

The smaller side part 44 has a smaller height and length than the greater side part 43 and is provided with only two insertion rods 47. It extends from the supporting member 27 for the back rest 28 forwardly over the member 5, as can be seen in FIG. 10. The larger side part 43 has three insertion rods 47, and extends from the supporting member 27 for the backrest 28 beyond the member 5 up to the front mounting piece 4, as can be seen from FIG. 6.

Furthermore, the larger side part 43 is provided with a height-adjustable arm support 49 which engages with two downwardly extending holding strips 50 into respective guiding grooves 51 of the side part 43 in a height-adjustable manner. The height adjustment of the arm support 49, which is performed advantangeously in a stepped manner, is provided by an arresting pin 52 which is arranged on the outer side of the side part 43, and selectively engages one of the openings 53 provided in one holding strip 50.

The side part 43, 44 with the insertion rods 47 and the arresting bracket 48 is formed as a one piece element of synthetic plastic material. Guiding grooves are also formed, for example, by molding, in the side part 43.

Figure 5:
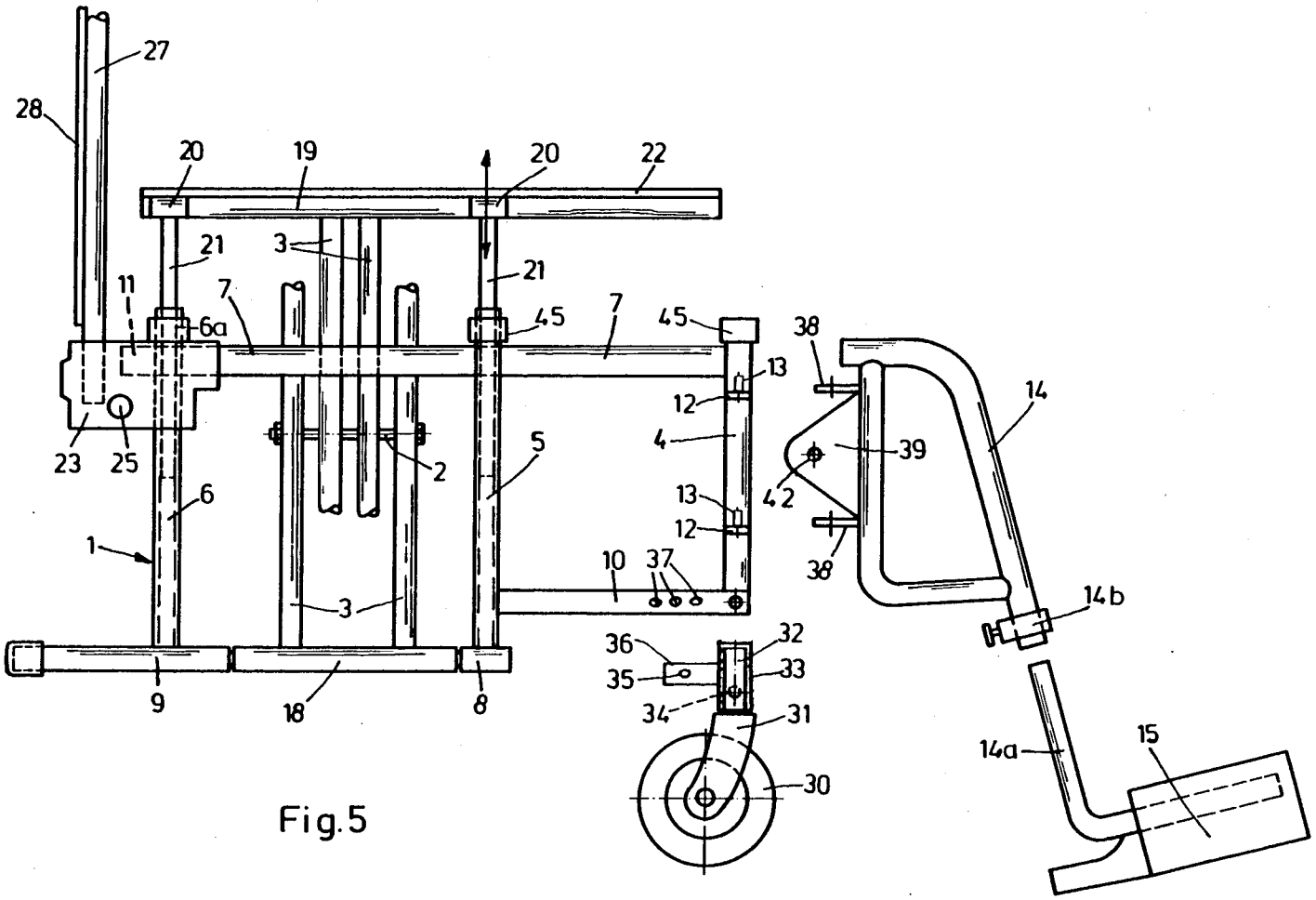
FIG. 5 is a side view of the side frame with the front wheels and the foot support removed.

The carrying arm 14 with the brackets 38 and the abutment plate 39 are also composed of synthetic plastic material. For allowing a height adjustment of the foot support 15 which is also composed of synthetic plastic material, each carrying arm 14 is formed of two parts, and two metal members 14*a* are inserted in the foot support 15. They are arranged in the tubular carrying arm 14 in a steplessly height-adjustable manner, and attachable by an annular fastening device 14*b*, as can be seen in FIGS. 1 and 5.

The side parts 43, 44 are formed from plates with a rectangular contour. The front end of the side parts 43, 44 is inclined and/or arcuate so as to narrow from above downwardly, and the side parts have a substantially trapezoidal shape.

It will be understood that each of the elements described above, or two or more together, may also find a useful application in other types of constructions differing from the types described above.

When the invention has been illustrated and described as embodied in a wheelchair, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of the prior art, fairly constitute essential characteristics of the generic or specific aspects of this invention.

What is claimed as new and desired to be protected by Letters Patent is set forth in the appended claims.

1. A wheelchair, comprising in combination two side frames;

link members, connected between said side frames, and crossing one another and pivotable about a common horizontal axis so as to fold said side frames in a folding movement;

front and rear wheels rotatably arranged on each of said side frames;

a back rest having upwardly extending back rest supporting members connected to said side frames;

a seat having seat supporting members which are attached to respective link members and movable upwardly and downwardly in dependence on the folding movement of said side frames;

a foot support;

each of said side frames being provided with guide receiving means for said seat supporting members, support means for said link members, a rear wheel axle block, and carrying arms for said foot support, each of said side frames together with said guide receiving means and said link member support means being formed as a one-piece element of synthetic plastic material, wherein said front wheels are steerable, said rear wheels being of a greater size than said front wheels and being manually drivable, wherein each of said side frames has a rectangular contour, said guide receiving means of each of said frame including an upright central guiding member and an upright rear guiding member, each of said side frames also having an upright front supporting member, two upper spacers arranged to hold said front supporting member and said guiding members at a distance from one another, a lower spacer extending between said front supporting member and said central guiding member, a bearing bush provided at a lower end of said central guiding member, and a support member provided at a lower end of said rear guiding member and extending coaxially to said bearing bush, and wherein said front supporting member is shorter than each of said guiding members, said lower spacer extending above said bearing bush and being connected with a lower end of said front supporting member.

2. A wheelchair as defined in claim 1, wherein each of said front wheels has a fork in which said front wheel is rotatably supported, said fork being provided with an upright pin and with a bearing sleeve in which said upright pin engages in a steerable manner, said bearing sleeve being mounted in a thrust joining region between a corresponding front supporting member and a corresponding lower spacer, and having an abutment rod which lies on said lower spacer and is secured thereto.

3. A wheelchair as defined in claim 2, and further comprising first attachment means which mount said bearing sleeve in the joining region between said front supporting member and said lower spacer, and second attachment means for securing said abutment rod to said lower spacer.

4. A wheelchair as defined in claim 1, wherein said foot support carrying arm is composed of synthetic plastic material, said foot support being composed of synthetic plastic material and having metal arms height-adjustably held in said foot support carrying arms.

5. A wheelchair as defined in claim 1, further comprising two plate-shaped side parts removably held on respective of said side frames, and composed of synthetic plastic material, and wherein said seat supporting members are movable upwardly and downwardly in a non-interfering manner on said side parts, respectively.

6. A wheelchair as defined in claim 5, wherein each of said side parts has a lower edge and is provided with at least one insertion member formed on said lower edge, each of said side front supporting members and guiding members having upper end portions formed as mounting pieces, each of said side frames having receiving pieces, each being composed of a synthetic plastic material and surrounding a corresponding mounting piece, each receiving piece having a vertical insertion slot in which said insertion members of said side parts engage.

7. A wheelchair as defined in claim 6, wherein said insertion slot of each receiving piece is arranged outside of said side frames, each of said side parts extending upwardly and as an outer extension of corresponding of said side frames.

8. A wheelchair as defined in claim 5, wherein each of said side parts has a rear edge and an upper region, and is provided at said rear edge and at said upper region with an arresting bracket, said back rest supporting members being releasably held by respective of said arresting brackets.

9. A wheelchair as defined in claim 5, wherein at least one of said side parts is provided with a height-adjustable arm support having downwardly extending holding strips provided with a plurality of openings, said one side part having guiding grooves arranged so that said holding strips are movably engaged in said guiding grooves and are arrestable therewithin in a stepped manner, and further comprising an arresting pin insertable in a respective one of said openings of said holding strips so as to arrest said holding strips.

10. A wheelchair as defined in claim 5, wherein each of said side frames has two bearing bushes in which each of said seat supporting members is rotatably held, said seat supporting members having height adjustable guiding parts which are mounted on said bearing bushes so as to extend downwardly and engage said central and rear guiding members so as to stabilize said side frames, said seat supporting members being held by said guiding parts in correspondence with a folding movement at inner sides of said side parts in a raisable and lowerable manner.

11. A wheelchair, comprising in combination two side frames;

link members crossing one another and pivotable about a common horizontal axis so as to fold said side frames in a folding movement;

front wheels and rear wheels rotatably arranged on said side frames;

a back rest having upwardly extending back rest supporting members;

a seat having seat supporting members which are movable upwardly and downwardly in dependence on the folding movement of said side frames;

a foot support;

each of said side frames being provided with guide receiving means for said seat supporting members, support means for said link members, a rear wheel axle block, and carrying arms for said foot support, each of said side frames together with said guide receiving means and said link member support means being formed as a one-piece element of synthetic plastic material, said guide receiving means of each said side frame including an upright central guiding member and an upright rear guiding member, each of said side frames also having an upright front supporting member and spacers arranged to hold said front supporting member and said guiding members at a distance from one another, and further comprising two plate like side parts removably held on respective of said side frames, and composed of synthetic plastic material, and wherein said seat supporting members are movable upwardly and downwardly in a non-interfering manner on said side parts, respectively, and wherein each of said side parts has a lower edge and is provided with at least one insertion member formed on said lower edge, each of said front supporting members and guiding members having upper end portions formed as mounting pieces, each of said side frames having receiving pieces, each being composed of a synthetic plastic material and surrounding a corresponding mounting piece, each receiving piece having a vertical insertion slot in which said insertion members of said side parts engage.

12. A wheelchair as defined in claim 11, wherein said front wheels are steerable, said rear wheels being of a greater size than said front wheels and manually drivable.

13. A wheel chair as defined in claim 11, wherein each of said side frames has a rectangular contour, said guide receiving means of each of said frame including an upright central guiding member and an upright rear guiding member, each of said side frames also having an upright front supporting member, two upper spacers arranged to hold said front supporting member and said guiding members at a distance from one another, a lower spacer extending between said front supporting member and said central guiding member, a bearing bush provided at a lower end of said central guiding member, and a support member provided at a lower end of said rear guiding member and extending coaxially to said bearing bush.

14. A wheelchair as defined in claim 13, wherein said front supporting member is shorter than each of said guiding members, said lower spacer extending above said bearing bush and being connected with a lower end of said front supporting member.

15. A wheelchair as defined in claim 13, wherein said front supporting member and said guiding members have end portions extending upwardly beyond said upper spacers and forming mounting pieces, said rear guiding member having a further mounting piece which extends coaxialy to said upper spacers.

16. A wheelchair as defined in claim 15, wherein said bearing bush extends from each side of said central guiding member, as seen in a wheel chair travelling direction, and wherein a bearing member extends beyond said rear guiding member forwardly in a direction away therefrom, and extends rearwardly in a direction toward said bearing bush and is rearwardly longer than said futher mounting piece.

17. A wheelchair as defined in claim 15, wherein said supporting member, said guiding members, said upper spacers, said bearing bush, and said mounting pieces are formed as tubes having a circular cross section, said lower spacer being formed as a bar.

18. A wheelchair as defined in claim 17, wherein said lower spacer is formed as a solid bar.

19. A wheelchair as defined in claim 17, wherein said lower spacer is formed as a hollow bar.

20. A wheelchair as defined in claim 15, wherein said rear wheels have a rear axle, said rear wheel axle block in each side frame being fixedly disposed in a joining region between said upper spacers said rear guiding member said mounting piece of said rear guiding member, and said further mounting piece, said rear wheel axle block being provided with a plurality of openings for selectively receiving said rear axle and receiving a lower end of one of said backrest supporting members.

21. A wheelchair as defined in claim 13, wherein each front supporting member has an aperture therein and attaching plates provided with bearing pins, each carrying arm having brackets suspended on said bearing pins of said attaching plates, said foot support carrying arm also having an abutment plate with an opening and an arresting pin extending through said opening of said abutment plate and said aperture for securing said foot support carrying arms to said front supporting member.

22. A wheelchair as defined in claim 21, wherein each of said side frames has web-like reinforcement means provided between said front supporting member and said lower spacer, between said lower spacer and said central guiding member, and between said plates and said front supporting member.

23. A wheelchair, comprising in combination two side frames;

link members, connected between said side frames, crossing one another and pivotable about a common horizontal axis so as to fold said side frames in a folding movement;

front and rear wheels rotatably arranged on each of said side frames;

a back rest having upwardly extending back rest supporting members connected to said side frames;

a seat having seat supporting members which are attached to respective link members and movable upwardly and downwardly in dependence on the folding movement of said side frames;

a foot support;

each of said side frames being provided with guide receiving means for said seat supporting members, support means for said link members, a rear wheel axle block, and carrying arms for said foot support, each of said side frames together with said guide receiving means and said link member support means being formed as a one-piece element of synthetic plastic material, wherein each of said side frames has a rectangular contour, said guide receiving means of each of said frame including an upright central guiding member and an upright rear guiding member, each of said side frames also having an upright front supporting member, two upper spacers arranged to hold said front supporting member and said guiding members at a distance from one another, a lower spacer extending between said front supporting membr and said central guiding member, a bearing bush provided at a lower end of said central guiding member, and a support member provided at a lowre end of said rear guiding member and extending coaxially to said bearing bush, wherein said front supporting member and said guiding members have end portions extending upwardly beyond said upper spacers and fórming mounting pieces, said rear guiding member having a further mounting piece which extends coaxially to said upper spacers, and wherein said bearing bush extends from each side of said central guiding member, as seen in a wheel chair travelling direction, and wherein said support member extends beyond said rear guiding member forwardly in a direction toward said central guiding member, and extends rearwardly in a direction away from said bearing bush and is rearwardly longer than said further mounting piece.

24. A wheelchair, comprising in combination two side frames;

link members, connected between said side frames, crossing one another and pivotable about a common horizontal axis so as to fold said side frames in a folding movement;

front and rear wheels rotatably arranged on each of said side frames;

a back rest having upwardly extending back rest supporting members connected to said side frames;

a seat having seat supporting members which are attached to respective link members and movable upwardly and downwardly in dependence on the folding movement of said side frames;

a foot support;

each of said side frames being provided with guide receiving means for said seat supporting members, support means for said link members, a rear wheel axle block, and carrying arms for said foot support, each of said side frames together with said guide receiving means and said link member support means being formed as a one-piece element of synthetic plastic material, wherein each of said side frames has a rectangular contour, said guide receiving means of each of said frame including an upright central guiding member and an upright rear guiding member, each of said side frames also having an upright front supporting member, two upper spacers arranged to hold said front supporting member and said guiding members at a distance from one another, a lower spacer extending between said front supporting member and said central guiding member, a bearing bush provided at a lower end of said central guiding member, and a support member provided at a lower end of said rear guiding member and extending coaxially to said bearing bush, wherein for securing each carrying arm to a respective front support member, each front supporting member has a aperture therein and attaching plates provided with bearing pins, each carrying arm having brackets suspended on said bearing pins of said attaching plates, said foot support carrying arm also having an abutment plate with an opening and an arresting pin extending through said opening of said abutment plate, and said aperture.

25. A wheelchair, comprising in combination two side frames;

link members crossing one another and pivotable about a common horizontal axis so as to fold said side frames in a folding movement;

front wheels and rear wheels rotatably arranged on said side frames;

a back rest having upwardly extending back rest supporting members;

a seat having seat supporting members which are movable upwardly and downwardly in dependence on the folding movement of said side frames;

a foot support;

each of said side frames being provided with guide receiving means for said seat supporting members, support means for said link members, a rear wheel axle block, and carrying arms for said foot support, each of said side frames together with said guide receiving means and said link member support means being formed as a one-piece element of synthetic plastic material, said guide receiving means of each said side frame including an upright central guiding member and an upright rear guiding member, each of said side frames also ahving an upright front supporting member and spacers arranged to hold said fron supporting member and said guiding members at a distance from one another, and further comprising two plate like side parts removably held on respective of said side frames, and composed of synthetic plastic material, and wherein said seat supporting members are movable upwardly and downwardly in a non-interfering manner on said side parts, respectively, and wherein each of said side frames has two bearing bushes in which each of said seat supporting members is rotatably held, said seat supporting members having height adjustable guiding parts which are mounted on said bearing bushes so as to extend downwardly and engage said central and rear guiding members so as to stabilize said side frames, said seat supporting members being held by said guiding parts in correspondence with a folding movement at inner sides of said side parts in a raisable and lowerable manner.

* * * * *